United States Patent [19]

McIntyre et al.

[11] Patent Number: 4,498,236

[45] Date of Patent: Feb. 12, 1985

[54] SHAVING INSTRUMENT COMPLEX

[76] Inventors: Marvin H. McIntyre; Ernest L. McIntyre, both of 410 S. 2nd St., Caseyville, Ill. 62232

[21] Appl. No.: 421,301

[22] Filed: Sep. 22, 1982

[51] Int. Cl.[3] ..... B26B 21/08

[52] U.S. Cl. ..... 30/34.1; 30/47; 30/53

[58] Field of Search ..... 30/32, 47, 34.1, 53, 30/34 R, 34 A, 34 B, 154

[56] References Cited

U.S. PATENT DOCUMENTS

| | | | |
|---|---|---|---|
| 843,923 | 2/1907 | Arnold | 30/47 |
| 937,992 | 10/1909 | Gilda | 30/34 R |
| 949,542 | 2/1910 | Levalley | 30/34 R |
| 1,048,696 | 12/1912 | Horton | 30/32 X |
| 2,242,900 | 5/1941 | Bender | 30/154 |
| 2,575,539 | 11/1951 | Bennett | 30/47 |
| 2,602,992 | 7/1952 | Elliott | 30/34 R |
| 2,861,339 | 11/1958 | Malecki | 30/32 X |
| 3,728,788 | 4/1973 | Pearson | 30/53 |
| 3,918,155 | 11/1975 | Atkins | 30/47 |
| 3,983,627 | 10/1976 | Montrasi | 30/53 |
| 4,288,919 | 9/1981 | Rait | 30/47 |

*Primary Examiner*—Jimmy C. Peters

*Attorney, Agent, or Firm*—Richard G. Heywood

[57] ABSTRACT

A reusable shaving instrument complex having a safety razor member with a guarded blade and a straight razor member with an exposed blade, and a unitary handle constructed and arranged to hold and carry both of said members during use and storage.

4 Claims, 10 Drawing Figures

SHAVING INSTRUMENT COMPLEX

BACKGROUND OF THE INVENTION

The present invention pertains generally to shaving instruments, and more particularly to improvements providing compound shaving devices in a single instrument.

Razors for shaving and cutting hair and the like have taken many forms, but traditionally fall into one of two classes: straight razors having an exposed blade, and safety razors having a guarded or protected blade. Straight razors of different styles or shapes have been used for centuries and provide many advantages; they are strong and durable, can be resharpened or honed to a fine edge through a lifetime of use, and provide accurate trimming of beards and sideburns and exceedingly close shaves even in difficult facial recesses, such as chin clefts, under lip and close to the nose. However, straight razors require some skill in use and maintenance, but are still in widespread usage today among professional barbers and the general public.

Safety razors have come into vogue in the last century, and offer the advantages of a safe, clean shave with minimum risk of facial injury, and the replaceable blades eliminate the need for special care in keeping the blade sharp and clean. More recently, the shaving industry has offered so-called one use or throw-away razors which are wasteful and expensive in the long run and such devices are outside the scope of the present invention.

SUMMARY OF THE INVENTION

The present invention pertains to a reuseable compound shaving instrument having both a safety razor member and a straight razor member, and a unitary handle for both of said members.

The primary object of the present invention is to provide a compound shaving instrument offering the convenience of having both safety razor means and straight razor means in a single device.

Another object of the invention is to provide a shaving instrument complex providing all of the advantages of both straight razor and safety razor shaving in a single, unitary device.

Another object is to provide a compound shaving instrument that is simple, strong, durable and economical in affording the user a selection of shaving options, and is reusable over a long period.

These and still other objects and advantages will become more apparent hereinafter.

DESCRIPTION OF THE DRAWINGS

In the accompanying drawings which illustrate preferred embodiments of the present invention, and wherein like numerals refer to like parts wherever they occur.

DESCRIPTION OF THE PREFERRED EMBODIMENTS

In the following description of the preferred embodiments it will become apparent that several alternative forms of safety razor and straight razor members may be interchangeable in the shaving instrument complex of the present invention. It should also be understood that various materials may be used in forming certain parts and, therefore, although the handle member is shown cross-hatched for metal in various views, it may be formed of plastic or other synthetic or substitute materials.

Figure 1:
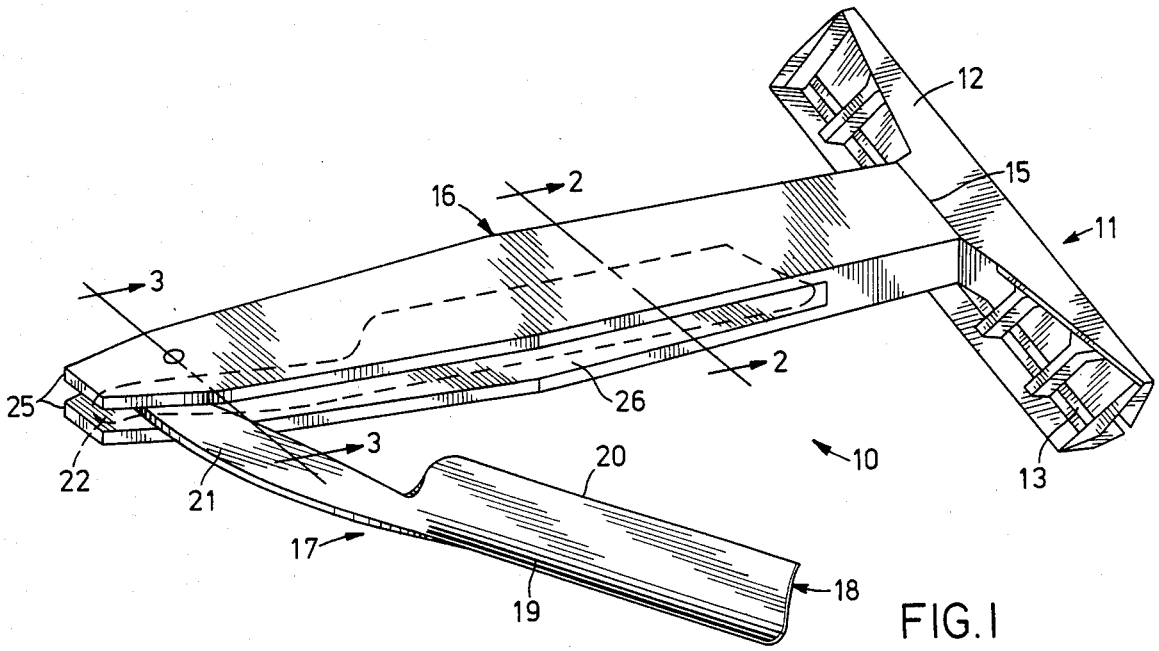
FIG. 1 is a perspective view illustrating one embodiment of a safety razor and straight razor complex with the straight razor in partly opened position and showing a closed position in broken lines.
Figure 2:
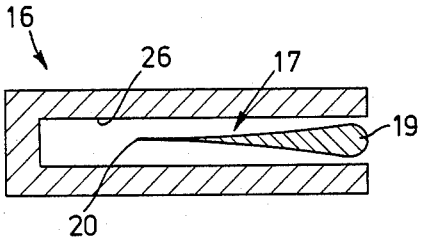
FIG. 2 is an enlarged cross-sectional view taken substantially along line 2—2 of FIG. 1, but showing the closed position of the straight razor.
Figure 3:
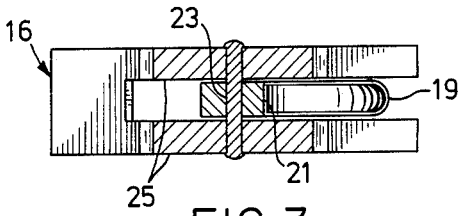
FIG. 3 is an enlarged cross-sectional view taken substantially along line 3—3 of FIG. 1, also showing the closed position of the straight razor member.

Referring now to FIGS. 1–3 wherein one embodiment is shown, the compound shaving instrument 10 has a safety razor member 11 with a shaving head 12 of the type known in the trade as an "injector" razor. This type of safety razor 11 has replaceable blades 13 that are injected into the head 12 between conventional guard plate lugs (not shown) by a dispensing device (not shown), thereby pushing out the used, worn blade for disposal. The shaving head 12 is centrally mounted on one end 15 of a handle member 16, which also forms the handle and the holder or guard housing for a straight razor member 17.

The razor member 17 is of substantially conventional construction having a wedge-shaped, hollow-ground blade portion 18 with a relatively thick, rounded spine or back 19 and a thin, keen edge 20. The blade 18 is formed of high quality tempered steel, and is integrally formed with a shank portion 21 having a terminal tang portion 22 extending past a pivotal mounting point (23). The end 25 of the handle member 16 remote from the safety razor head 12 is split to accommodate the shank portion 21 and tang 22 therebetween, and the length of the handle member is hollowed to provide an internal chamber or recess 26 to form a housing for the blade 18 of the straight razor 17. The shank 21 of the straight razor 17 is hinged on a pivot pin 27 for swinging movement between an extended open position for use and a folded, closed position retracted within the handle recess 26 for storage and during use of the safety razor member 11. Thus, the shaving instrument complex 10 provides dual shaving members 11 and 17, both mounted on or carried by a single handle 16 that also functions as a housing (26) for the straight razor 17.

Figure 4:
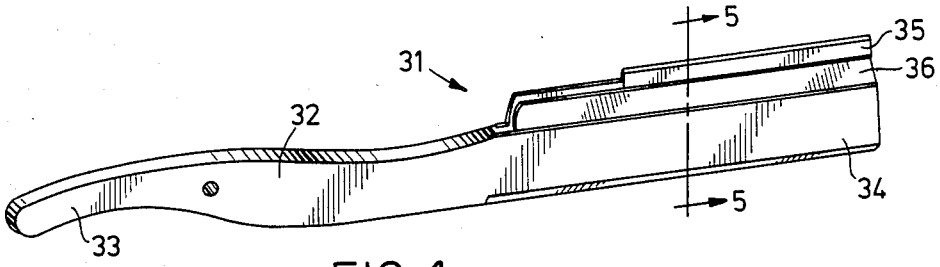
FIG. 4 is a perspective view showing an alternative form of the straight razor member useful in the present invention.
Figure 5:
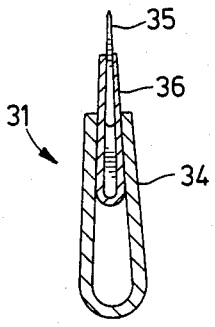
FIG. 5 is an enlarged cross-sectional view taken substantially along line 5—5 of FIG. 4.

FIGS. 4 and 5 show an alternative form of straight razor 31 that can be substituted for the hollow-ground razor 17. In this form, the body of the razor 31, which includes shank and tang portions 32 and 33, has a channel-shaped spine or blade holder portion 34 formed of spring steel. A replaceable blade 35 of the injector-type is removably mounted in another yieldable channel member 36, which in turn is removably positioned in the channel body of the spine 34. The two channel means doubly grip the blade 35 to firmly hold it in position for use, but the channel member 36 is easily removed from the spine 34 and the blade 35 is relatively easily removed from the channel member 36 without the additional gripping pressure of the spine 34.

Figure 6:
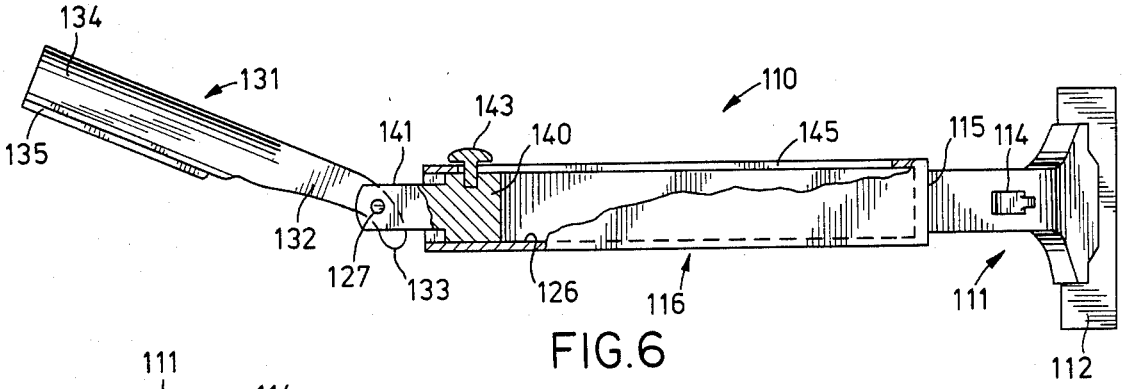
FIG. 6 is a top plan view illustrating another embodiment of a safety razor and straight razor complex with the straight razor being shown in extended position for use.
Figure 7:
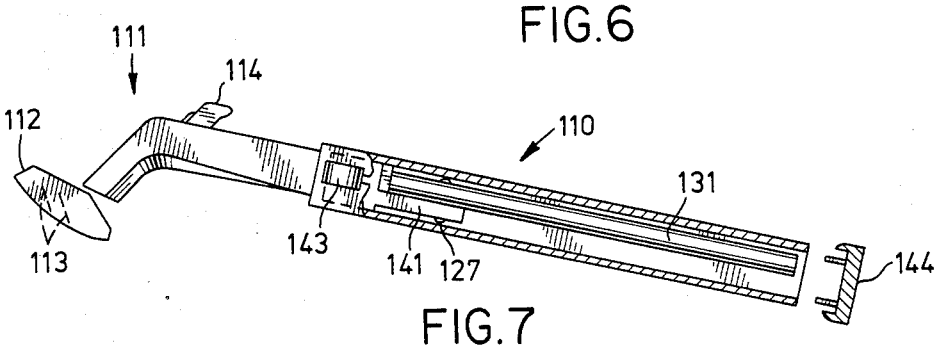
FIG. 7 is a side elevational view, partly broken away, of the FIG. 6 embodiment, but showing the straight razor in retracted position and also showing an end cap for the handle housing member.

Referring now to FIGS. 6 and 7, another embodiment of compound shaving instrument 110 has a safety razor member 111 with a shaving head 112 having dual blades 113 and being known in the trade as a "twin blade system" (marketed by Gillette under the trademark ATRA and by Schick under the trademark TRAC II). In this type of safety razor 111, the entire head 112 is replaceable through an internal connecting mechanism (not shown) by operating a push button or lever 114. The safety razor 111 is mounted on one end 115 of a handle member 116 also forming the handle and housing for a straight razor 131 of the construction shown in FIGS. 4 and 5 (or similar to the form shown in FIGS. 1–3, if desired).

The length of the handle member 116 is provided with an internal chamber or recess 126 to fully accommodate the straight razor 131 therein in stored position, and a guide block 140 is slidably mounted in the handle chamber 126 and has an extension arm or plate 141 on which the shank 132 of the straight razor 131 is hinged by a pivot pin 127. One wall of the handle 116 has an elongated slot 142 therein to accommodate an operating lever or knob 143 connected to the block 140 and projecting outwardly of the housing 116. It will be clear that the straight razor 131 is movable between an extended, open position for use and a retracted, closed position within the housing chamber 126 by actuating the lever 143 to move the block 140 lengthwise in the housing 116. As shown in FIG. 7, an end cap 144 may be provided to snap-fit into the open end of the housing chamber 126 when the straight razor 131 is stored within the housing 116.

Figure 8:
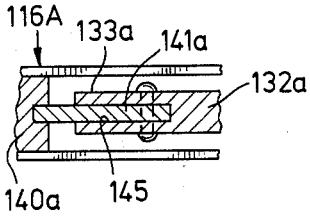
FIG. 8 is an enlarged cross-sectional view of an alternative hinge construction for the straight razor member of FIG. 6.

FIG. 8 illustrates a modification of the FIGS. 6–7 embodiment in which the shank and tang portions 132*a* and 133*a* of the straight razor 131A are split or slotted, as at 145, to receive the extension arm 141*a* therebetween.

Figure 9:
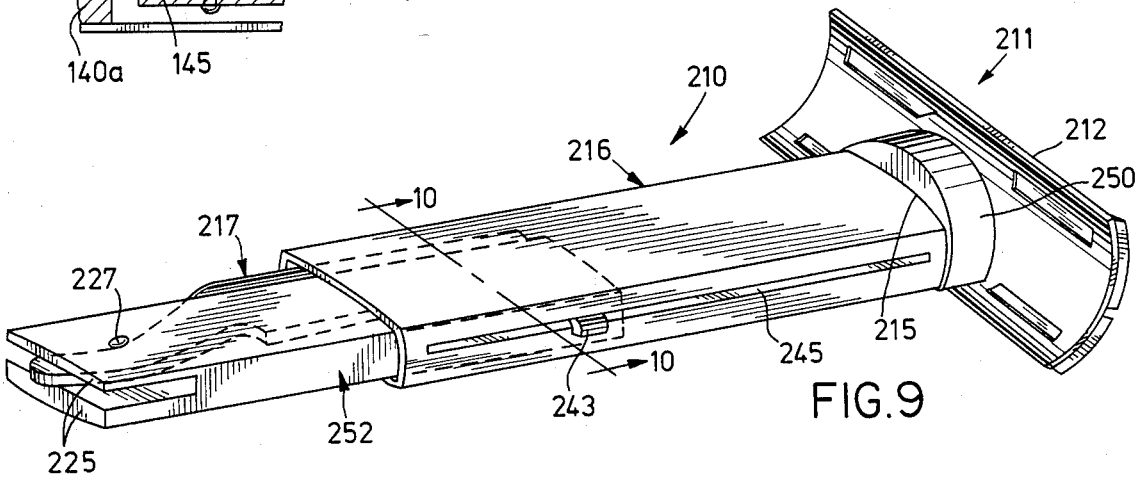
FIG. 9 is a perspective view of a third embodiment of a safety razor and straight razor complex with the straight razor being shown in partly extended position.
Figure 10:
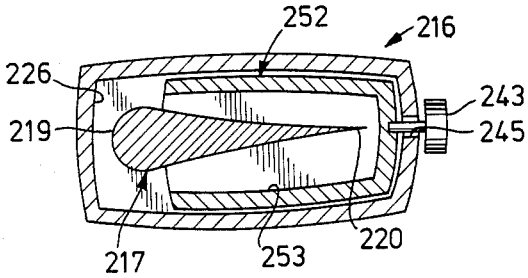
FIG. 10 is a greatly enlarged cross-sectional view taken substantially along line 10—10 of FIG. 9.

Referring to FIGS. 9 and 10, a further embodiment of a compound shaving instrument 210 comprises a safety razor 211 with a shaving head 212 for a conventional double-edge razor blade (not shown) and a hollow-ground straight razor 217, both of which are carried by a handle member 216. The double-edge safety razor 211 is mounted on one end 215 of the handle 216, and includes the usual annular finger control 250 for operating an internal gear mechanism (not shown) for opening the shaving head 212 to remove the double-edge blade for cleaning or replacement. In this embodiment, the straight razor 217 is hingedly connected, as at 227, to a secondary housing block 252 that is slidably mounted in the internal chamber 226 defined by the handle member 216. The movement of the secondary housing 252 between a retracted, closed position with the chamber 227 and an extended, open position for use is controlled by a lever or knob 243 connected to the housing block 252 and extending through an elongated slot 245 in a side wall of the handle 216. The housing block 252 is hollowed out to form a recess 253 to receive the straight razor 217 (231) for side opening swinging movement on the pivot pin 227 out of the housing block 252 for use when the secondary housing block 252 is in extended position.

The shaving instrument complex 10, 110, 210 offers complete availability in shaving options in addition to the individual advantages and benefits afforded by the respective shaving members. It will also be readily apparent that different safety razor heads 12, 112 and 212 may be used with different straight razor members 17, 31 and that other changes and modifications will be readily apparent to those skilled in the art.

What we claim is:

1. A compound shaving instrument comprising, in combination: an elongated main handle member having first and second opposite ends and a hollow internal chamber therebetween; safety razor means mounted on the first end of said handle member and including a shaving head that is permanently attached to the first end, and replaceable razor blade means having a cutting edge and being removably held by said shaving head in a position guarding the cutting edge against unrestricted cutting contact with a user; and straight razor means movably mounted on the second end of said handle member and including integrally formed shank and blade portions, said blade portion being carried on one end of said shank portion and having an exposed and unguarded cutting edge during use, said shank portion having a pivotal mounting connection adjacent to its other end for swinging movement to carry said integral blade portion to various angular positions relative to said handle member for shaving purposes: and said internal chamber of said handle member forming a housing to accommodate and store said blade portion of said straight razor means during non-use thereof, whereby said safety razor means and said straight razor means are selectively usable from opposite ends of the same handle member for obtaining an optimum total shave.

2. The compound shaving instrument according to claim 1, in which said internal chamber of said handle member extends from said second end toward said first end, and said straight razor means is slidably movable longitudinally of said elongated handle member into and out of said chamber through said second end between an internal closed and stored position and an extended open position for use.

3. The compound shaving instrument according to claim 12, which includes a block member longitudinally slidably positioned in the internal chamber of said handle member, said shank portion of said straight razor means having its pivotal mounting connection on said block member, and actuating means connected to said block member and extending externally of said housing member for controlling the longitudinal sliding movement of said block member relative to said housing member for moving said straight razor means between said internal and extended positions.

4. The compound shaving instrument according to claim 1, in which said hollow internal chamber of said main housing member has an elongated side opening extending from said second end, said shank portion of said straight razor means having its pivotal mounting connection on said second end, and said straight razor means being swingable on said pivotal connection to a folded position with said blade portion being housed and stored through said side opening into said internal chamber.

* * * * *

UNITED STATES PATENT OFFICE

CERTIFICATE OF CORRECTION

PATENT NO. : 4,498,236

DATED : February 12, 1985

INVENTOR(S) : Marvin H. McIntyre and Ernest L. McIntyre

It is certified that error appears in the above-identified patent and that said Letters Patent are hereby corrected as shown below:

Claim 3, column 4, line 50, "12" should be --2--.

Signed and Sealed this

*Twenty-eighth* Day of *May 1985*

[SEAL]

*Attest:*

DONALD J. QUIGG

*Attesting Officer*

*Acting Commissioner of Patents and Trademarks*